United States Patent [19]

Maitland

[11] 4,181,560

[45] Jan. 1, 1980

[54] ELECTRO-MECHANICAL MARKING DEVICE

[75] Inventor: Roy Maitland, Laguna Niguel, Calif.

[73] Assignee: Count Numbering Machine, Inc., Chicago, Ill.

[21] Appl. No.: 925,558

[22] Filed: Jul. 17, 1978

Related U.S. Application Data

[63] Continuation-in-part of Ser. No. 714,010, Aug. 13, 1976, abandoned.

[51] Int. Cl.[2] ..... B41F 1/00

[52] U.S. Cl. ..... 156/542; 101/27; 101/41; 101/85; 101/103; 101/333

[58] Field of Search ..... 101/41–44, 101/27, 103, 104, 105, 333, 334, 368, 379, 316, 318, 85, 106, 107–111, 405; 156/542

[56] References Cited

U.S. PATENT DOCUMENTS

| | | | |
|---|---|---|---|
| 2,646,747 | 7/1953 | Reumerman et al. | 101/85 |
| 2,654,312 | 10/1953 | Phipps | 101/43 X |
| 2,707,915 | 5/1955 | Nefzger | 101/318 |
| 2,784,668 | 3/1957 | Poje | 101/368 X |
| 2,851,944 | 9/1958 | Prohaska | 101/44 |
| 3,018,720 | 1/1962 | Nichols | 101/41 |
| 3,115,826 | 12/1963 | Reinhardt et al. | 101/316 X |
| 3,174,426 | 3/1965 | Boekeloo et al. | 101/42 |
| 3,190,054 | 6/1965 | Arnold et al. | 101/41 UX |
| 3,358,414 | 12/1967 | Hersh et al. | 101/41 UX |
| 3,388,662 | 6/1968 | Rarreby | 101/405 |
| 3,435,760 | 4/1969 | Harrison | 101/27 X |
| 3,729,362 | 4/1973 | French et al. | 156/542 |
| 3,837,276 | 9/1974 | Reichert | 101/41 |

*Primary Examiner*—Clifford D. Crowder

*Attorney, Agent, or Firm*—Emrich, Root, O'Keeffe & Lee

[57] ABSTRACT

An electro-mechanical marking device for use with various types of apparatus, having a stack sheet feed assembly, includes an open-ended housing adapted to loosely receive and hold interchangeable marking heads in a self-leveling position. The interchangeable marking heads include a resiliently mounted food device which engages the stacked sheets prior to the marking actuated position. The housing includes a solenoid which selectively energizes a drive element to move the element between an at rest position, and an actuated position. The interchangeable marking heads, such as barcoders, imprinters, marginal word imprinters, daters and numberers, hot die stampers, foil stampers and label affixers, are held in engagement with the drive element to permit the operative movement of the selected interchangeable marking head between the inward at rest position and an outward actuated position.

12 Claims, 21 Drawing Figures

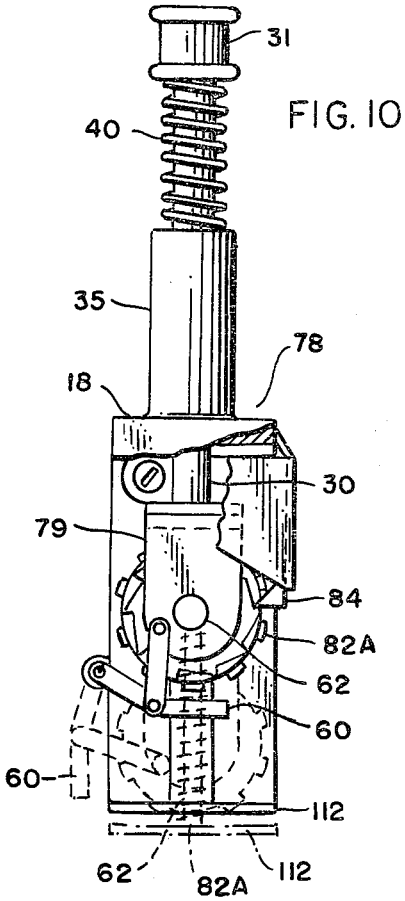
FIG. 10
FIG. 11
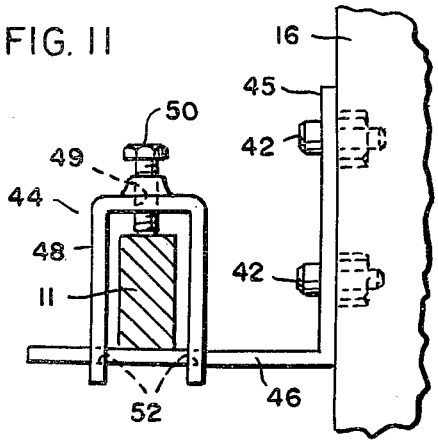
FIG. 12
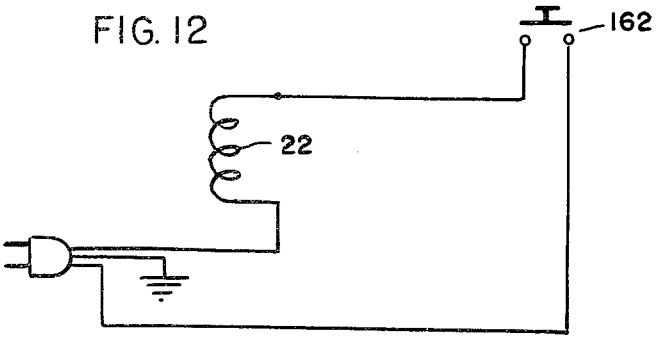
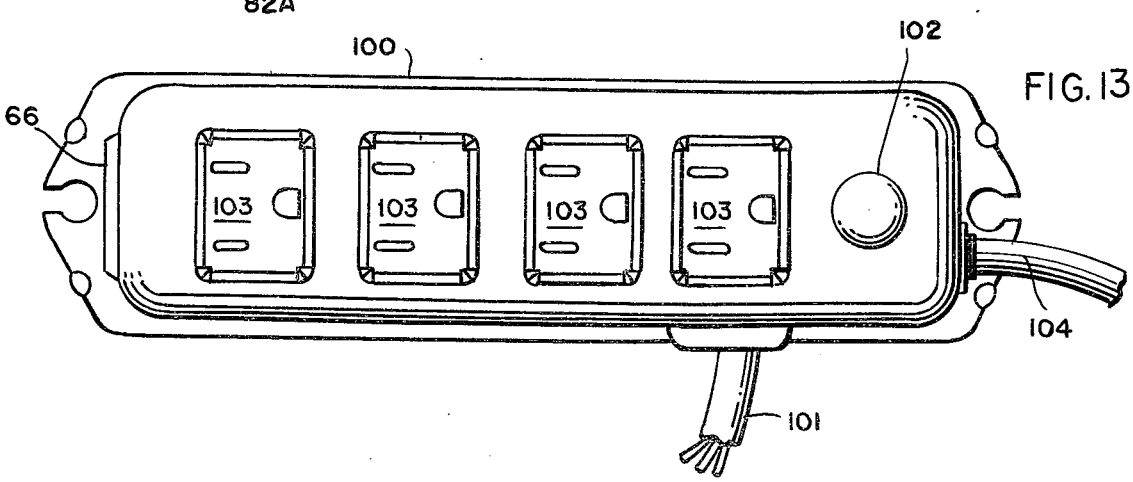
FIG. 13
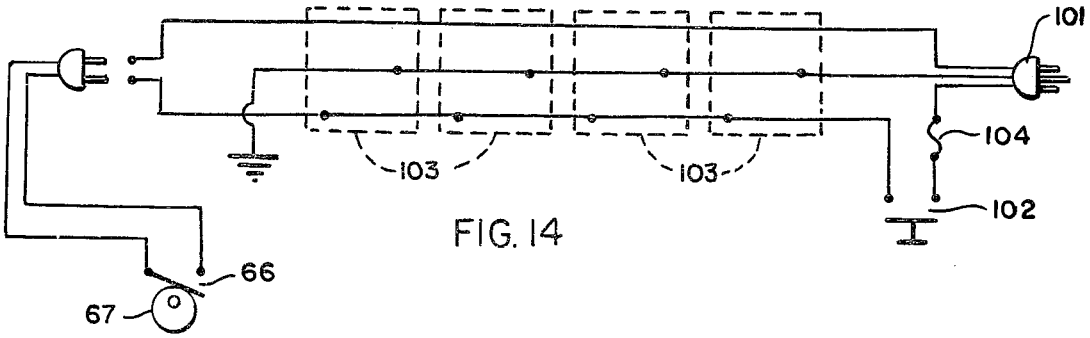
FIG. 14

ELECTRO-MECHANICAL MARKING DEVICE

RELATED APPLICATION

This application is a continuation-in-part application of U.S. Ser. No. 714,010 filed Aug. 13, 1976 now abandoned and assigned to the Assignee of the present invention.

BACKGROUND OF THE INVENTION

In applications involving presses, duplicators, folders, conveyors and other types of equipment having a stack sheet infeed assembly thereon, it is desirable to utilize therewith, an electro-mechanical marking device in conjunction with the stack sheet feed assembly to provide a desired marking on each of the sheets prior to the subsequent operation being performed thereon. No other marking devices have been employed to be utilized on the stack feed infeed assembly of any existing type of equipment which performs some subsequent operation, such as printing, collating and folding.

Moreover, prior art devices are useful only in performing a single function or operation, for example, some devices may code, some may date and some may imprint but not in conjunction with an infeed mechanism of existing equipment which performs other or subsequent operations such as printing, collating and folding. Also, because each of these prior art devices, which provide one function or operation only, are costly and expensive to manufacture, such costs have prevented their widespread application and use.

Furthermore, the prior art devices are unable to self-adjust to stacked sheet assemblies that are constantly changing in height or to stacked sheets that become curled, unlevel or uneven. Thus, to overcome such difficulties, such devices must be shut down and manually adjusted to accommodate such conditions. Also, under such conditions the marking quality of such prior art devices have been less than desirable.

Additionally, the amount of time and labor spent by the user of such apparatus as a separate operation, for example, printing, folding and/or collating has severely restricted the acquiring of such apparatus. Lastly, such separately functioning devices require and utilized considerable space and are complicated in structure and expensive to manufacture.

SUMMARY OF THE INVENTION

One object of the present invention is to provide an electro-mechanical marking device which is adapted to receive and operate a plurality of interchangeable marking heads.

It is a further object of the present invention to provide an electro-mechanical marking device which may be rapidly secured to an apparatus having a stack sheet infeed system.

It is still another object of the present invention to provide an electro-mechanical marking device utilizing relatively few parts, which is of simple construction and reliable in operation.

It is still a further object of the present invention to provide a control system for synchronizing the operation of a plurality of electro-mechanical marking devices.

It is another object of the present invention to provide an electro-mechanical marking device capable of performing one or more operations while the machine to which it is attached is performing its original function.

It is yet another object of the present invention to provide an electro-mechanical marking device having a resiliently mounted foot device to provide self-leveling of the marking device during the outward actuation position.

The electro-mechanical marking device of the present invention includes a solenoid mounted in the housing which energizes an armature element to move the same from an at rest position to an extended actuated position. The housing includes two slide guides mounted to the open end of the housing and adapted to receive the U-shaped frame of the interchangeable marking heads, as will hereinafter be described. The U-shaped frame of each interchangeable head is loosely and floatingly attached to the open end of the housing adjacent the slide guide by fastening means.

Each of the interchangeable marking heads include a U-shaped frame member, a tubular sleeve through which an elongated post member extends upwardly therefrom, the end of which includes a striking plate which contacts the armature element. The elongated post member is held in the at rest position by a helical compressed spring positioned between the end of the tubular sleeve and the striking plate against the armature element. The other end of the elongated post member is attached to the working mechanism of each of the interchangeable marking heads, for example, a band dater and coder, a bar-coder and imprinter, a marginal word imprinter, a hot foil stamper and a numberer.

The interchangeable marking heads each include a main shaft portion extending outwardly therefrom and having openings therein which are adapted to receive and resiliently mount a marking device foot element. The foot element is comprised of a U-shaped base plate having parallel foot shafts extending upwardly therefrom. Each of the shafts include compression springs therearound, with the shaft ends being engageable with a snap ring to resiliently mount the foot element to the interchangeable marking head.

The interchangeable band dating and coding head includes a common band dater or coder having extensions thereof which include projections thereon. The interchangeable band dater and coder is mounted to the electro-mechanical marking device by sliding the U-shaped frame into the slide guides of the open end housing and securing the set screw. This positions the striking plate against the armature element in the at rest position.

To operate the electro-mechanical device, fastening means is provided to attach the device housing to the particular apparatus to permit the electro-mechanical marking device to perform the particular function on the sheets of material which are removed sequentially from a stack sheet infeed assembly.

Upon energization of the solenoid, the drive element is driven and moved from its at rest position downwardly to its extended actuated position. Simultaneously with the movement of the drive element, the interchangeable dater and coder head is moved from its at rest position to an extended actuated position thereby causing the marking device foot element to engage the sheet stack to secure the stacked sheets and level any curls or wrinkles in the paper. Then, the individual marking head engages the surface of the stack of sheets to effect a pressure contact between the interchangeable marking head and the top sheet of the stacked sheets to mark the same with the particular indicia on the interchangeable marking head. The solenoid is connected to an electric circuit having a manual operated switch therewith which interrupts the regular operating cycle of the solenoid in order to resynchronize the machine with the sequence of the precollated papers in the event the sequence is broken. The electrical impulse that energizes the solenoid is directed to the machine through a junction box. The junction box circuit includes an incoming electrical impulse interrupted by a normally open switch which is activated by a moving cam on the machine to which it is attached. The junction box contains also a manually operated switch which is utilized to synchronize all of the impulses leaving the junction box through its plurality of outlets, if it is desired that more than one marking head be utilized on the same machine. In normal operation, the two manually operated swithces, one on the machine and one on the junction box are in a closed position, and a normally open switch controls the electrical impulse to the solenoid in time with the rotating cam on the machine. When the cam of the machine to which it is attached, closes the normally open switch, the solenoid is energized to drive the armature against the striking plate thereby depressing the helical spring and driving the elongated shaft downwards causing the interchangeable marking head to imprint the indicia thereon on the top sheet of the infeed stack. When the rotating cam releases the normally open switch, the electro-mechanical marking device returns to an at rest position and the machine removes the topmost imprinted sheet to perform its originally intended operation and exposes the next sheet for the next cycle of operation.

In a further embodiment of the present invention, the interchangeable marking head provides bar-coding and imprinting. The interchangeable bar-coder and imprinter head includes a platen having projections extending outwardly from the ends thereof. The face of the platen accepts a double sided tape to which a rubber or metal engraved printing or coding plate is attached. The elongated post member is attachable to the platen with the opposite end thereof being firmly secured by spring pressure against the end of the armature element, as previously described. The projections extending outwardly from the platen are positioned within the grooves within the inside surface of the depending leg members of the U-shaped frame.

In still a further embodiment of the present invention, the interchangeable marking head is a marginal word imprinter. The interchangeable marginal word imprinter head includes a U-shaped frame having a rotatable marginal word imprinter head mounted within a U-shaped bracket. The imprinter head may have six, eight and ten sides thereon, with one end having a ratchet gear mounted thereon which is selectively engaged by a spring mounted pawl. The pawl and ratchet mechanism act as an indexing mechanism for the marginal word imprinter head. One end of the elongated post member is attachable to the U-shaped bracket, with the other end being inserted through the tubular sleeve and secured by spring pressure against the end of the armature. With each downward stroke of the marking device, the pawl engages the ratchet gear to rotate the marginal word imprinter head in the U-shaped bracket to index the same.

A further embodiment of the electro-mechanical marking device includes an interchangeable marking head which provides hot foil stamping. In this embodiment, the U-shaped frame is similar to that set forth above except the tubular sleeve on the connecting web is somewhat larger to accommodate an elongated soldering heating element which acts as the elongated post member. The end of the armature engages a striking plate attached to a receptacle into which is secured a replaceable electrical soldering iron element to push the same downwardly to the actuated position. The soldering iron element end, opposite the attachment to the electrical receptacle, is attached to a platen having side panels mounted thereon which are adapted to be received by the grooves in the inward surface of the U-shaped frame. To the platen, an engraving plate is secured with high temperature double sided tape. When the solenoid is energized the armature drives downwards on the striking plate causing the previously heated platen, on which is mounted an engraved plate, to strike the top sheet of the pile through the foil thereby leaving a foil replica of the engraved plate on the paper. On the return stroke the foil material is advanced for the next engagement.

A further embodiment of the electro-mechanical marking device includes an interchangeable marking head which provides for the affixing of pressure sensitive pre-printed labels. This head is identical to the bar-coding and imprinting head except that attached thereto is a label feed and take up mechanism which is actuated by the downstroke of the platen. The label is projected from its carrier substrate by bending the web sharply over a bar member. The projected label is pressed down and affixed to the top sheet of the pile by the imprinting platen. Further action is identical to that of the imprinting head, as set forth above.

A further embodiment of the electro-mechanical marking device includes an interchangeable marking head which provides for consecutive, duplicate, triplicate, quadruplicate, five, six, twelve or repeat numbering. However, it is within the scope of the present invention to include skip numbering. This conventional numbering head consists of a five, six, seven or eight wheel numbering head within the U-shaped bracket at the end of the elongated post, enclosed within the U-shaped frame, which is cam actuated when the armature depresses on the striking plate to move the head into an actuated position.

The resiliently mounted marking device foot element attached to the interchangeable marking heads improves the quality of the printed image automatically on level or unlevel stacked sheets and provides uniform quality imprinting or marking on wrinkled or curled stacked sheet assemblies of constantly changing height without manual adjustment. The print quality is superior to that possible in previous prior art devices because the prior art devices require manual adjustment to the changing stack height and generally rely on hand pressure driven devices. Moreover, such previous devices do not allow for unlevel or uneven material except by overdriving the marking device and thus producing uneven and inferior quality images. When the solenoid of the present interchangeable marking head is actuated, the compression springs force the base plate of the foot element downwardly against the paper stack thereby securing the paper in a fixed position and leveling any curls or wrinkles in the paper. The marking device further continues its downward thrust until it prints its image on the paper within the opening in the U-shaped base plate. When the helical compression springs of the marking devices return the device to its at rest position, the compression springs maintain the base plate of the foot against the paper stack until the marking device raises sufficiently for the main shaft to lift the foot element back against the base of the U-shaped frame assembly.

The numbering head includes a bar member which is mounted to both the U-shaped bracket and to the U-shaped member which positions a felt inking device in contact with the numbering head when the numbering head is in the at rest position. When the numbering head is actuated and is moved to its extended position the bar member and the mounted inking device thereon is pivoted out of the way of the downward stroke of the numbering head.

In the following interchangeable heads, namely the bar-coder and imprinter, the dater and coder, the marginal word imprinter and the numberer, each of these interchangeable marking heads include a bar member for holding an inking device adjacent the insignia mounted onto the marking head. A novel ink applying cartridge adapted for use to the above types of interchangeable heads is set forth and claimed in copending application entitled INK SUPPLY CARTRIDGE, Ser. No. 875,379 filed as a continuation-in-part application of Ser. No. 714,004, now abandoned, by the present Applicant and assigned to the same Assignee as the present invention.

BRIEF DESCRIPTION OF THE DRAWINGS

FIG. 10 is a perspective view of an interchangeable numbering head and foot assembly which is adapted to be attached to the electro-mechanical marking device in accordance with the present invention;

FIG. 11 is a partial view of the fastening elements used in mounting the electro-mechanical marking device to the frame of a printing apparatus;

FIG. 12 is an electrical diagram illustrating the electronic circuit used with the electro-mechanical marking device in accordance with the present invention;

FIG. 13 is a top plan view of the junction box used with the electro-mechanical marking device in accordance with the present invention;

FIG. 14 is an electrical diagram illustrating the electrical circuit used with the junction box in accordance with the present invention;

DETAILED DESCRIPTION

Figure 1:
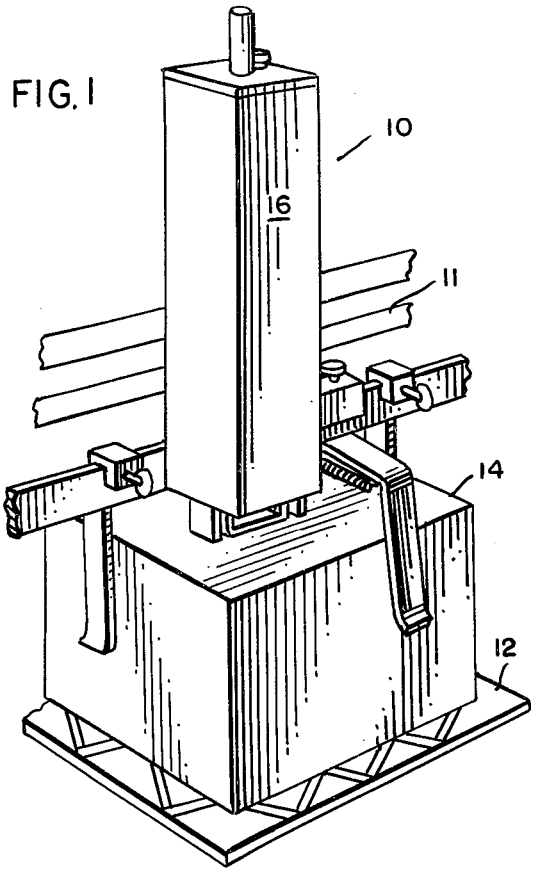
FIG. 1 is a partial perspective view of a printing apparatus having a stack sheet feed assembly incorporating the electro-mechanical marking device in accordance with the present invention.
Figure 2:
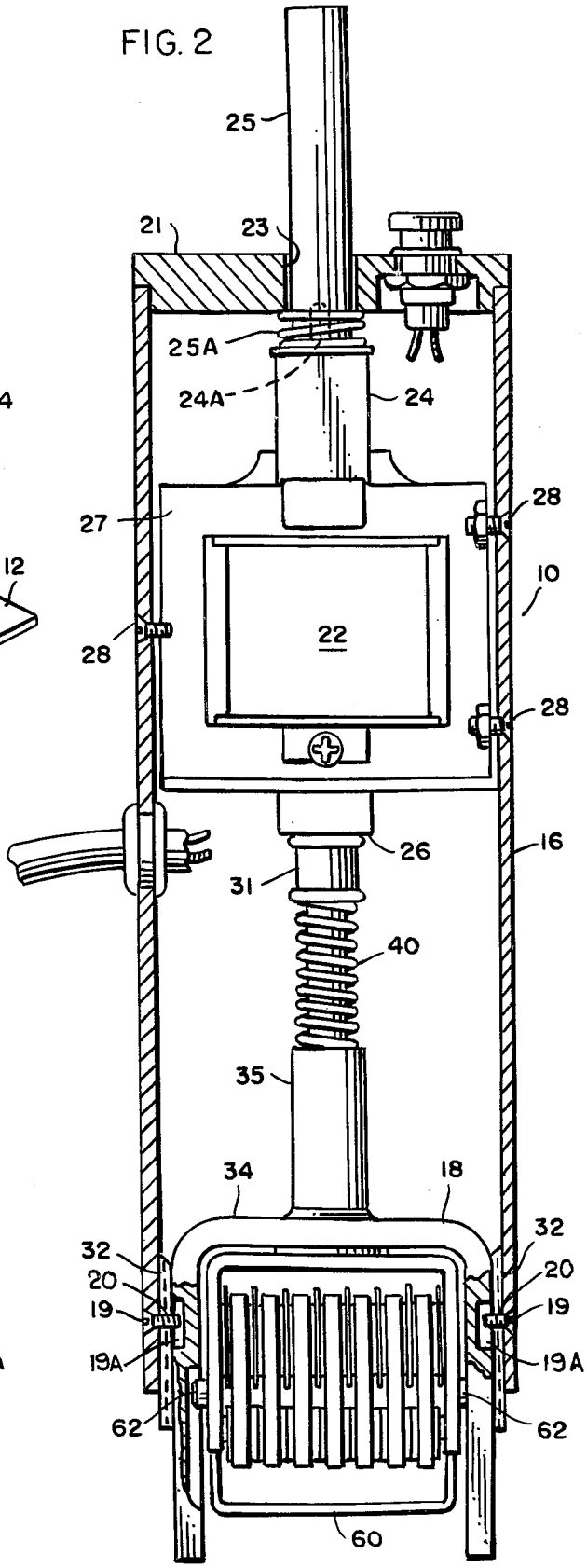
FIG. 2 is a longitudinal cross-sectional view of the electro-mechanical marking device in accordance with the present invention incorporating an interchangeable dating and coding head in accordance with the present invention.
Figure 3:
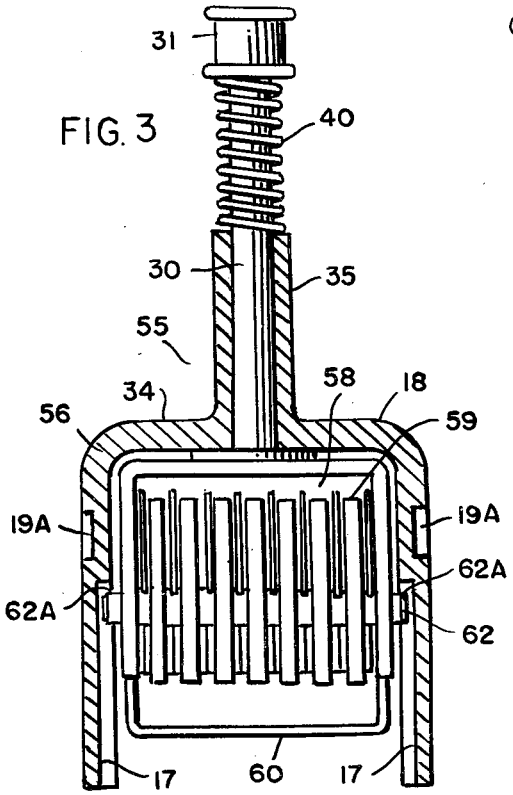
FIG. 3 is a side elevational view of an interchangeable dating and coding head which is adapted to be attached to the electro-mechanical marking device in accordance with the present invention.

Referring now to the drawings in greater detail, wherein like numbers have been used throughout the various views to designate similar parts, there is illustrated in FIGS. 1 and 2, an electro-mechanical device 10 in which the interchangeable marking heads according to the present invention are employed. The electro-mechanical marking device 10 is mounted on an apparatus or machine 11 having stack sheet infeed apparatus 12, with the individual sheets 14 of material being fed from the stack sheet feed apparatus 12 into the machine 11 to have the specific operation performed thereon, such as printing, duplicating, folding, conveying and the like. The electro-mechanical marking device 10 includes a vertically disposed housing 16 that is mounted on the machine 11, as will hereinafter be described.

An electrically operated solenoid 22 is positioned within the housing 16, which when energized, imparts a downward movement to a vertically disposed armature or drive element 24. The housing 16 includes a closed end 21 having a central opening 23 therein which is adapted to receive and permit the upper portion, attached by a fastening means 24A to the drive element 24, to extend above the housing 16. Preferably, a nylon retainer means 25A is provided between drive element 24 and closed end 21 to hold a constant down pressure on drive element 24. The armature or drive element 24 extends through the solenoid 22 and includes a lower portion 26 which is adapted to engage the striking plate end 31 of the extension post 30 the interchangeable marking heads, as will hereinafter be described. The armature 24 includes a a frame 27 which is removably secured to the housing 16 by a number of fastening means 28. If desired, the fastening means may be composed of an electrically insulative material to insulate the electrical components of the device 10 from the housing 16. The slide guides member 32 are a pair of depending legs which extend downwardly below the housing 16 to a position just above the uppermost sheet in the stack sheet feed apparatus 12.

The slide guides 32 are grooved to accept the U-shaped frame 18 of the interchangeable marking heads. A set or locking screw 19 is adapted to be received by a counterbore in slide guides 32, is adapted to project into recessed area 19A in the U-shaped frame 18 thereby removably and floatingly securing the interchangeable head to the electro-mechanical marking device. The set or locking screw 19 locks into the counterbore 20 of the housing slide guides and is of such a length that the end thereof projects into the recessed area 19A in the U-shaped frame 18 as shown in FIGS. 2 and 17–21. Importantly, the screws 19 do not secure the U-shaped frame by pressure of threads, but rather, the distance between the slide guides 32 and the U-shaped frame is about 0.020 inch to permit the U-shaped frame and head device to loosely float within the slide guides 32, as will hereinafter be described.

Prior to the electro-mechanical marking device 10 being placed in operation, the device may be attached by fastening means 44 (FIG. 11) to the machine 11. An L-shaped bracket 45 includes a lower extension 46 substantially horizontally therefrom. A U-shaped attachment bracket 48 extends downwardly over a portion of the apparatus or machine 11 with the bracket having horizontally aligned bores therein through which the second leg extension 46 of the L-shaped bracket may be extended. The U-shaped bracket member 48 has a tapped bore 49 formed in the web portion thereof which threaded bore is engaged by a screw 50. By loosening or tightening the screw 50, the lower extension 46 is disposed in the openings 52 of the U-shaped bracket member 48 and may be released or locked relative to the machine 11 to dispose the housing 16 at a desired lateral position relative to the stacked sheet feed apparatus 12 (not shown). The housing 16 may be vertically adjusted relative to the stack 14 by loosening or tightening of the screw fastening means 42 extending through elongated slots (not shown) in the L-shaped bracket 45. Thus, the electro-mechanical marking device 10 may be mounted to the machine 11 in operative relationship with the stack of sheets to be fed into machine 11 by merely loosening the fastening means 42 to raise or lower the housing 16, as desired.

In FIGS. 3 and 17–21 the interchangeable marking head 55, which is particularly adaptable for use in the electro-mechanical marking device 10, includes an interchangeable dating and coding head 56 having a U-shaped bracket 58 containing a common band dater 59, having a main shaft or projections 62 thereon, which are adapted to be received by the grooves 17 located on the inside of U-shaped frame member 18.

The interchangeable marking heads each includes the mainshaft 62 portion extending outwardly therefrom and openings 62A (not shown) therein which are adapted to receive and resiliently mount a marking device foot element 110. The foot element 110 is comprised of a U-shaped base plate 112 having parallel foot shafts 114 extending upwardly therefrom. Each of the shafts 114 include compression springs 116 therearound, with the shaft ends 117 being engageable with a snap ring 118 to resiliently mount the foot element 110 to the mainshaft 62 portion of the marking head 55. The elongated post member 30 is attached to the U-shaped bracket 58 and passes through the U-shaped frame 18 and tubular sleeve 35 extending up and including a striking plate 31 on the end thereof. Between striking plate 31 and tubular sleve 35 there is a helical compressed spring 40 which holds head 55 in an at rest position against lower portion 26 of armature 24 when the same is inserted into electro-mechanical marking device 10. Thus, the interchangeable band dater and coder head 56 is mounted to the electro-mechanical marking device 10 by sliding the U-shaped frame 18 into the slide guides 32 of the open end housing and securing the set screws 19 into a counterbore 20 in the housing slide guides 32. This positions the striking plate 31 against the armature element in the at rest position. The band dater 59 on the dater and coder head 56 is of the nature of a common band dater which may be manually indexed and includes a bar member 60 for holding an inking pad adjacent the band dater 59, as is well known in the art.

Upon the energization of the solenoid 22, the drive element 24 is driven and moved from its at rest position downwardly to its extended actuated position. Simultaneously with the movement of the drive element 24, the attached interchangeable dater and coder head 56 is moved from its at rest position to an extended actuated position whereby the foot element 110 engages the sheets 14 to secure the sheets and level any curl or wrinkles in the sheets. Then the band dater or coder 59 engages or imprints the insignia or mark on the uppermost one of the sheets in the stack of paper in the infeed stack 12.

Thus, simultaneously with the movement of the drive elements 24 and lower portion 26, the interchangeable dater and coder head 56, via striking head 31, is moved from its at rest position to an extended actuated position whereby the foot element 110 and then the individual marking head engages the surface of the stack of sheets to effect a pressure contact between the interchangeable marking head and the top sheet 14 of the stacked sheets to mark the same with the particular indicia on the interchangeable marking head. The solenoid 22 is connected to an electric circuit (FIG. 12) having a manual operated switch 162 therewith, which interrupts the regular operating cycle of the solenoid in order to resynchronize the machine 11 with the sequence of precollated papers in the event the sequence is broken. The electrical impulse that energizes the solenoid 22 is directed to the machine through a junction box 100 (FIG. 13). The junction box circuit (FIG. 14) includes an incoming electrical impulse interrupted by a normally open switch 66 which is activated by a moving cam 67 on the machine 11 to which it is attached. The junction box 100 contains also a manually operated switch 102 which is utilized to synchronize all of the impulses leaving the junction box through its plurality of outlets 103, if it is desired that more than one interchangeable marking head is to be utilized on the same machine. In normal operation, the two manually operated switches 62 and 102, one in the device 10 and one on the junction box 100 are in a closed position, and a normally open switch 66 controls the electrical impulse to the solenoid 22 in time with the rotating cam 67 on the machine 11. When the cam 67 of the machine 11 to which it is attached, closes the normally open switch 66, the solenoid 22 is energized to drive the armature 26 against the striking plate 31 thereby depressing the helical spring 40 and driving the elongated shaft 30 downwards causing the interchangeable marking head 55 to imprint the indicia thereon on the top sheet 14 of the infeed stack apparatus 12. When the rotating cam 67 releases the normally open switch 66, the electro-mechanical marking device 10 returns to an at rest position and the machine removes the topmost imprinted sheet to perform its originally intended operation and exposes the next sheet for the next cycle of operation. If desired, junction box 100 may contain a circuit breaker (not shown), as a safety precaution.

Figure 17:
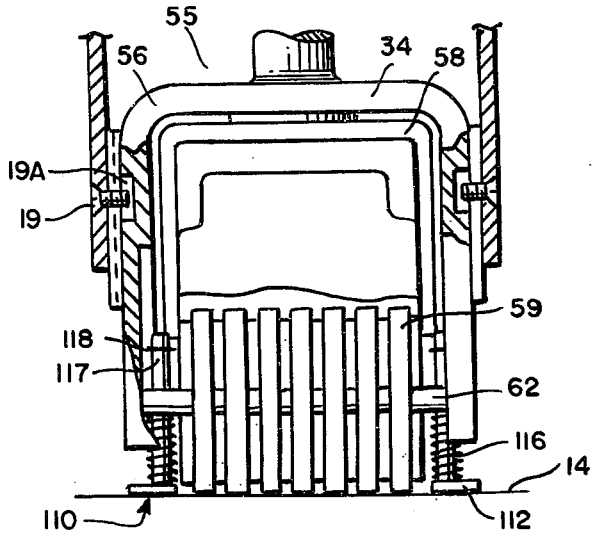
FIG. 17 is a side elevational view of an interchangeable dating and coding head and foot assembly in accordance with the present invention showing the engagement of the marking device with a preferred level of stacked sheets.
Figure 18:
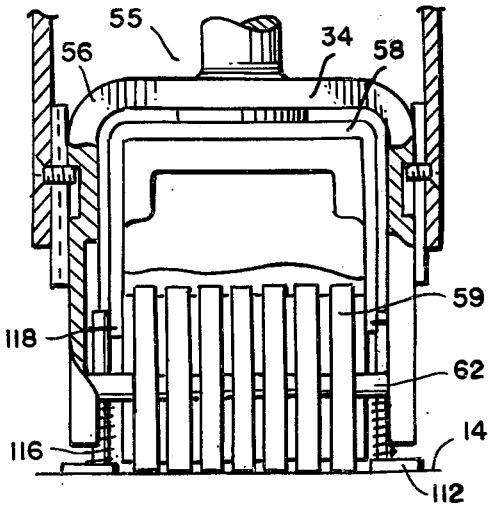
FIG. 18 is a side elevational view of the marking device of FIG. 17 showing the engagement of the marking device to a lower level of stacked sheets.
Figure 19:
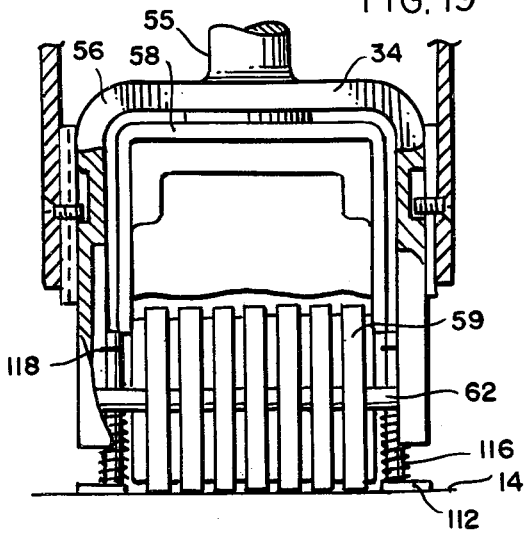
FIG. 19 is a side elevational view of the marking device of FIG. 17 showing the engagement of the marking device to a higher level of stacked sheets.
Figure 20:
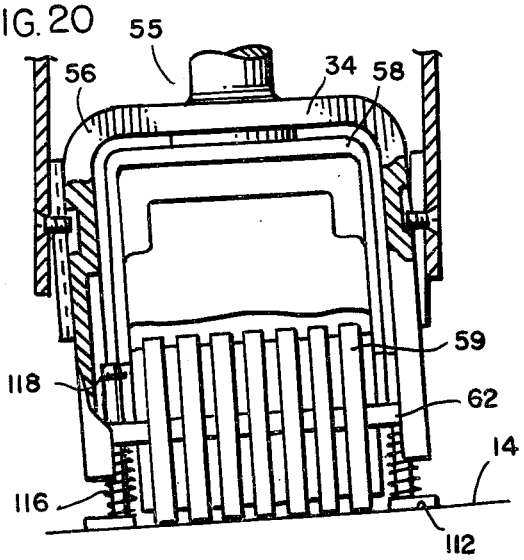
FIGS. 20 and 21 are side elevational views of the marking device of FIG. 17 showing the engagement and alignment of the marking device with unleveled stacked sheets.
Figure 21:
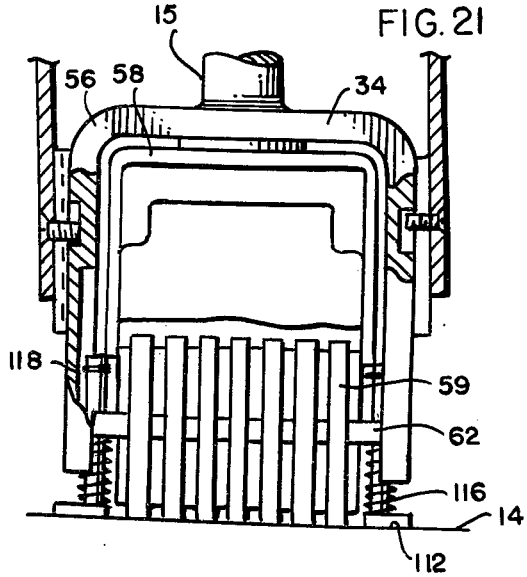

The resiliently mounted marking device foot element 110 attached to the marking head 55 automatically improves the quality of the printed image on level (FIG. 17) or unlevel (FIGS. 20 and 21) stacked sheets 14 by first engaging the stacked sheets 14 to hold the sheets in a wrinkle free and uncurled condition. Additionally, by utilizing compression springs 116 about each of the shafts 114 and the locking screw 19 in counterbore 20, the foot element 114 and marking head 55 are resilient and loosely mounted to permit uniform quality printing on constantly changing heights of stacked sheets 14 (as shown in FIGS. 17 and 18) as well as on unlevel stacked sheets 14 (as shown in FIGS. 19 and 20). This result occurs because the marking head 55 is loosely and floatingly mounted to the slide guides 32 to permit the marking head to seek its own level and heights with respect to the unlevel stacked sheets 14 to thereby automatically permit the head 55 to mark stacked sheets that are also varying in height.

In operation, the marking head 55 is actuated downwardly thereby compressing the compression springs 116 to thereby move the U-shaped base plate 112 downwardly and away from the base of the U-shaped frame 18 to engage the stacked sheets 14. The marking head continues downwardly until the marking device 55, or more specifically the band dater 59, engages and prints an image or mark on the stacked sheet 14. When the compression spring 40 partially returns the device 55 to its inward at rest position, the compression springs 116 maintain the base plate 112 of the foot element 110 in engagement with the stacked sheets 14 until the device 55 raises sufficiently for the main shaft 62 via snap ring 118 and foot shafts 114 to return the foot element against the base of the U-shaped frame 18 or to its at rest position.

In a further embodiment of the present invention, the interchangeable marking head 55 includes a bar-coding and imprinting head 73. The interchangeable bar-coder and imprinting head 73 (FIG. 4) includes a platen 74 having projections 75 mounted thereon and extending outwardly from the ends 76 thereof. However, it is within the scope of this invention to machine the projections 75 integral to the ends of the platen. To the face of the platen 74 is attached a double sided tape 77 to which a rubber or metal engraved printing or coding plate 78 may be attached. The elongated post member 30 is attachable to the platen 74 with the opposite end having the striking plate 31 thereon, and being engageable with the U-shaped frame 18 through the use of the tubular sleeve 35. Helical spring 40 engages the striking plate 31, as described previously with respect to FIG. 3, to hold the had against the armature 26. The projections 75 extending outwardly from the platen 74 are positioned within the grooves 17 within the inside surface of the depending leg members of U-shaped frame 18.

In still a further embodiment of the present invention, the interchangeable marking head 55 is a marginal word imprinter head 78. The interchangeable marginal word imprinter head 78 (FIGS. 5–16 and 15–16) includes a U-shaped bracket 79 having openings 81 in the sides 80 which are adapted to receive and to hold a rotatable marginal word imprinter wheel 82. The imprinter wheel 82 may have six, eight and ten sides thereof, as desired, with one end thereof having a ratchet gear 83 mounted thereon which is selectively engaged by a spring mounted pawl assembly 84, which provides an automatic indexing mechanism for the marginal word imprinter head 78. The elongated post member 30 is attached to the U-shaped bracket 79 and then inserted through the tubular sleeve 35 of the U-shaped frame member 18. After the post member 30 is inserted through the tubular sleeve 35, the helical spring 40 is inserted thereon and the striking plate 31 is attached to the end of the post member 30.

The interchangeable marginal word imprinter head 78 each includes a mainshaft 62 portion extending outwardly therefrom and openings 62A (FIG. 15) therein which are adapted to receive and resiliently mount a marking device foot element 110. As set forth previously, the foot element 110 is comprised of a U-shaped base plate 112 having parallel foot shafts 114 extending upwardly therefrom. Each of the shafts 114 include compression springs 116 therearound, with the shaft ends 117 being engageable with a snap ring 118 to resiliently mount the foot element 110 to the mainshaft 62 portion of the head 78. As set forth above, the interchangeable marginal word imprinter head 78 is then mounted to slide guides 32 of the housing 16 to complete the assembly of the electro-mechanical marker device 10, with each downward stroke of the armature marking device 78, the pawl 84 engages the ratchet gear 83 to rotate the marginal word imprinter head and index the same for the next imprinting operation. Thus, with the marginal word imprinter 78 it is possible to print on precollated paper and imprint marginal words at the same time by affixing appropriate rubber printing plate with double sided tape.

The resiliently mounted marking device foot element 110 attached to the imprinter head 78 automatically improves the quality of the printed image on level (FIG. 16) or unlevel (for example FIGS. 19 and 20) stacked sheets 14 by first engaging the stacked sheets 14 to hold the sheets in a wrinkle free and uncurled condition. Additionally, by utilizing compression springs 116 about each of the shafts 114 and the locking screw 19 in counterbore 20, the foot elements 114 and imprinter head 78 are resilient and loosely mounted to permit uniform quality printing on constantly changing heights of stacked sheets 14 as well as on unlevel stacked sheets 14. This result occurs because the imprinter head 78 is loosely and floatingly mounted to the slide guides 32 to permit the imprinter head to seek its own level and heights with respect to the unlevel stacked sheets 14 to thereby automatically permit the head 78 to mark stacked sheets that are also varying in height.

In operation, the imprinter head 78 is actuated downwardly thereby compressing the compression springs 116 to thereby move the U-shaped base plate 112 downwardly and away from the base of the U-shaped frame 18 to engage the stacked sheets 14. The imprinter head continues downwardly until the head engages and prints an image or mark on the stacked sheet 14. When the compression spring 40 (FIG. 6) partially returns the head 78 to its inward at rest position, the compression springs 116 maintain the base plate 112 of the foot element 110 in engagement with the stacked sheets 14 until the head 78 raises sufficiently for the main shaft 62 via snap ring 118 and foot shafts 114 to return the foot element against the base of the U-shaped frame 18 or to its at rest position.

Figure 7:
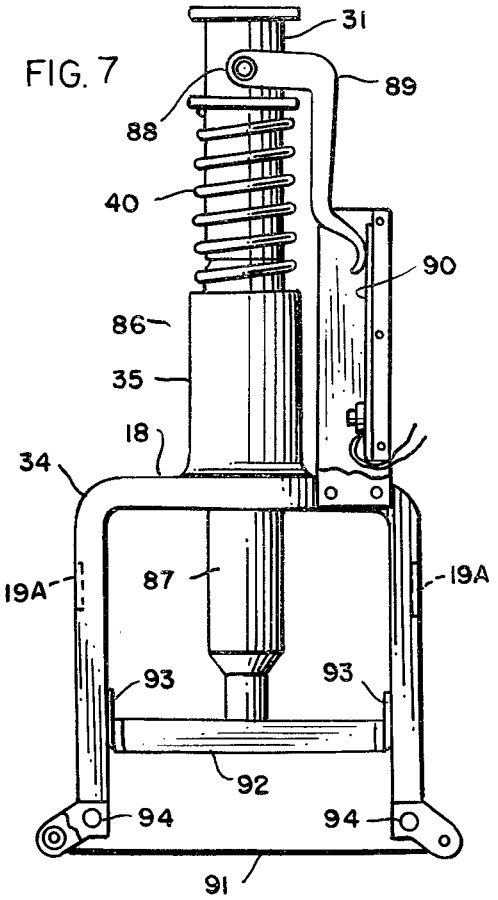
FIG. 7 is a perspective view of an interchangeable heat stamping head which may be attached to the electro-mechanical marking device in accordance with the present invention.
Figure 8:
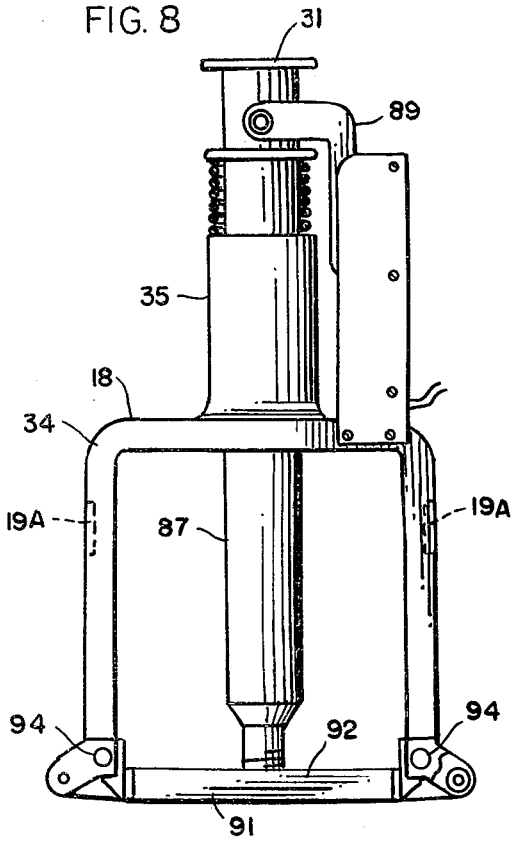
FIG. 8 is a perspective view of the electro-mechanical marking device having an interchangeable heat stamping head in the actuated position.
Figure 9:
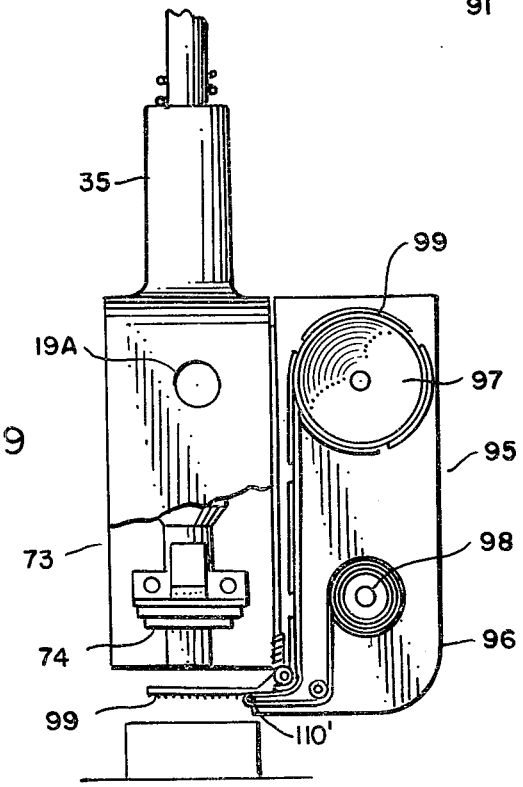
FIG. 9 is a cross-sectional view showing the attachment of an interchangeable label affixing head to the electro-mechanical marking device in accordance with the present invention.
Figure 15:
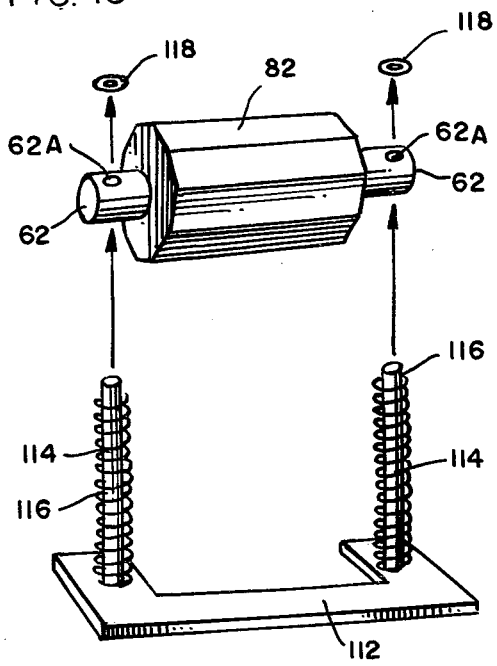
FIG. 15 is an exploded perspective view showing the mounting of the foot assembly to an interchangeable marginal word imprinted head in accordance with the present invention.
Figure 16:
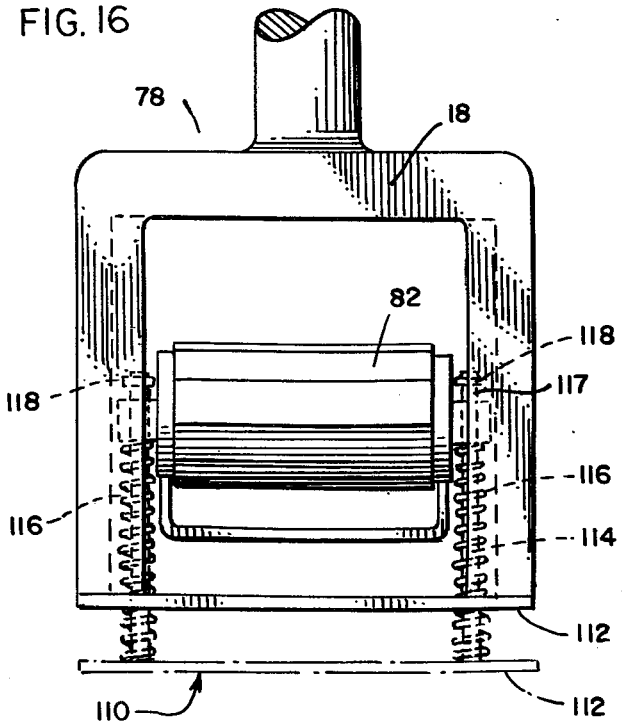
FIG. 16 is a side elevational view of an interchangeable dating and coding head and foot assembly which is adapted to be attached to the electro-mechanical marking device in accordance with the present invention.

A further embodiment of the electro-mechanical marking device is shown in FIGS. 7 and 8 and includes an interchangeable marking head 55 which provides a hot foil stamping head 86. In this embodiment, the U-shaped frame 18 is similar to that set forth above except the tubular sleeve 35 on the connecting web 34 is somewhat larger to accommodate an elongated soldering heating element 87 which acts as the elongated post member 30. The end of the armature 26 (not shown) engages a striking plate 31 attached to an electrical receptacle 88 into which is secured a replaceable electrical soldering iron element 87 to push the same downwardly to the actuated position. The soldering iron element 87 includes an end portion, opposite the attachment to the electrical receptacle, which is attached to a platen 92 having side panels 93 mounted thereon, preferably composed of Transite, a trademark owned by Johns Manville Corp. for asbestos board, which are adapted to be received by the grooves 17 (not shown) in the inward surface of the U-shaped frame 18. An engraving plate (not shown) is secured with high temperature double sided tape to the platen 92. The electrical receptacle 88 includes electrical contacts 89 which are in sliding contact with an electrical connection 90 to provide a continuous circuit during the movement of the heating element 87 of the hot foil stamping head 86 from its at rest position, as shown in FIG. 7 to its extended actuated position, as shown in FIG. 8, to thereby engage a foil 91 mounted by take-up rolls 94 onto the end of the depending legs of U-shaped frame member 18 to heat stamp the foil upon a substrate material.

When the solenoid 22 is energized the armature 26 is moved from its at rest position to its extended actuated position and thereby moves striking plate 31 and attached elongated soldering element 87 and the heating platen 92 to strike the top sheet of the substrate material through the foil 91 thereby leaving a foil replica of the engraved plate on the substrate. A helical compressed spring 40 returns the hot foil stamping head 86 to its inward at rest position and foil 91 is advanced for the next hot foil stamping operation.

Figure 4:
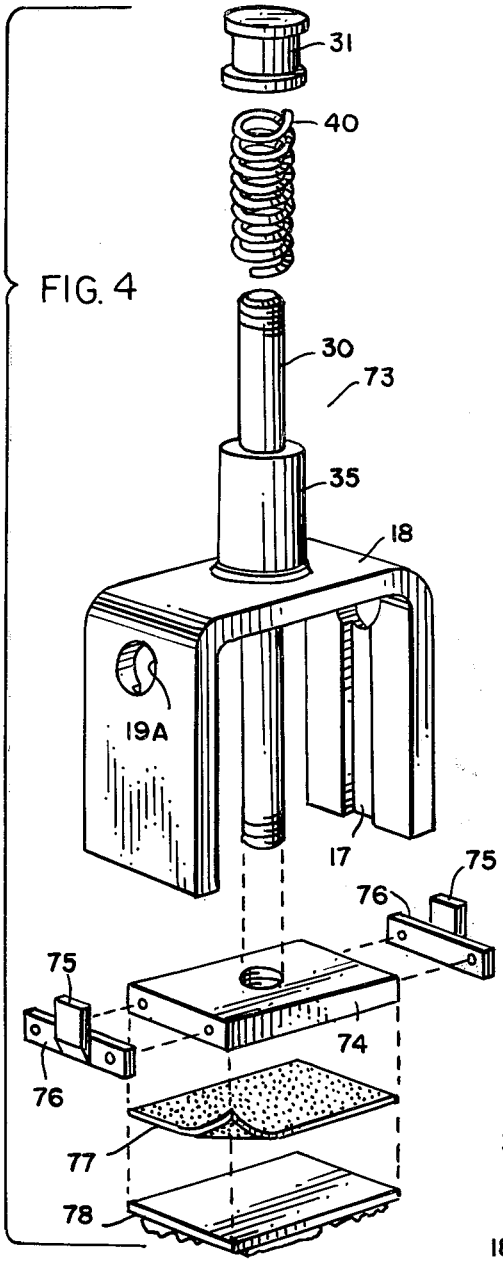
FIG. 4 is an enlarged perspective view of an interchangeable bar-coder and imprinter head which is adapted to be attached to the electro-mechanical marking device in accordance with the present invention.
Figure 5:
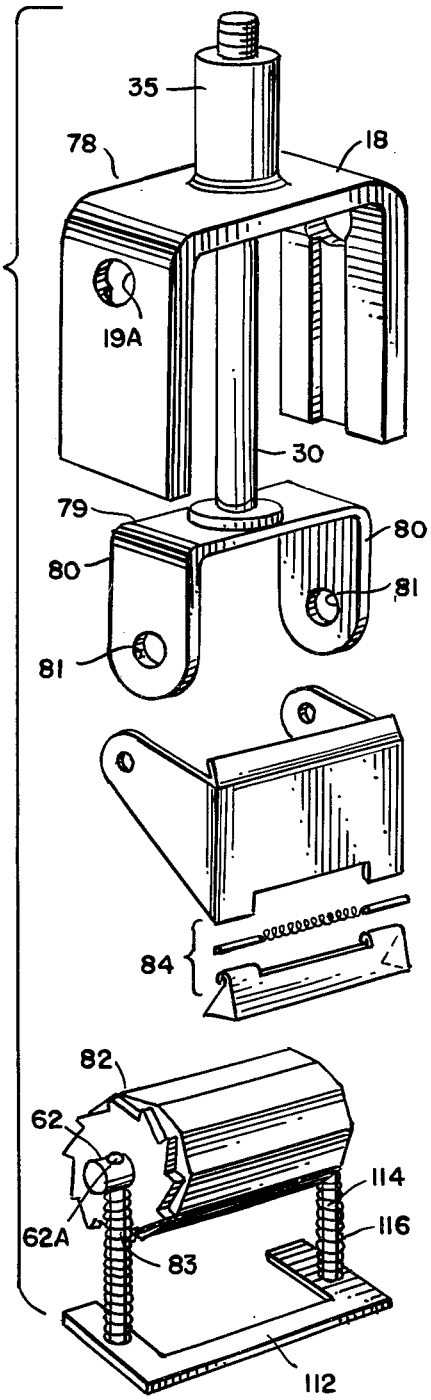
FIG. 5 is an exploded perspective view of an interchangeable marginal word imprinter head and foot assembly which is adapted to be attached to the electro-mechanical marking device in accordance with the present invention.
Figure 6:
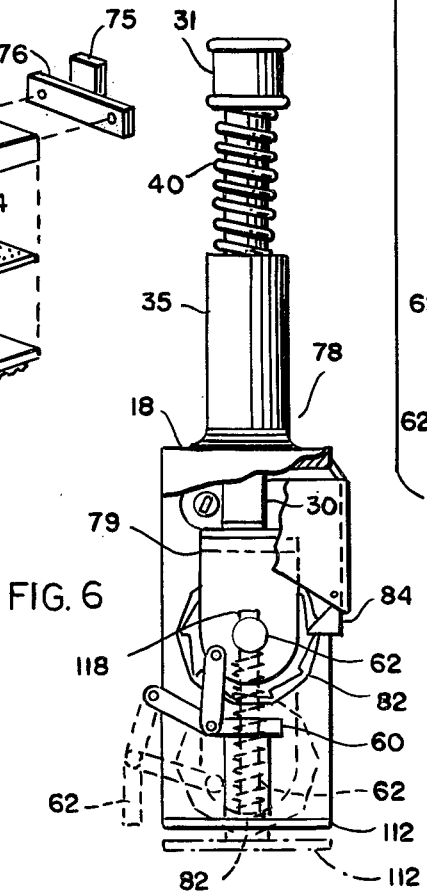
FIG. 6 is a cross-sectional view of the interchangeable marginal word imprinter head and foot assembly in the electro-mechanical marking device showing the oepration thereof between an at rest position and an extended actuated position.

The electro-mechanical marking device 10 may also include an interchangeable marking head 55 which provides for the affixing of pressure sensitive preprinted labels. This label affixing head is identical to the bar-coding and imprinting head 73 as shown in FIG. 4, except that attached thereto is a label feed and take up mechanism 95 actuated by the downstroke of the platen. The label feeding mechanism 95 (FIG. 9) includes a frame member 96 having a feed roll 97 and a take up roll 98 mounted thereon. The label 99 is projected from its carrier substrate by bending the web sharply over a bar member 110'. The projected label is pressed down and affixed to the top sheet of the pile by the imprinting platen 74. Further action is identical to that of the imprinting head, as set forth above.

A further embodiment of the electro-mechanical marking device includes an interchangeable marking head 78 which provides for consecutive, duplicate, triplicate, quadruplicate, five, six, twelve, repeat numbering, or skip numbering. This conventional numbering head 78 (FIG. 10) consisting of a five, six, seven or eight wheel numbering head 82A (only partially shown) within the U-shaped bracket 79 at the end of the elongated post 30 and enclosed within the U-shaped frame, with a plurality of wheels being selectively engaged with spring mounted pawl mechanism 84 which provides an indexing mechanism for the numbering head 78, in the same manner as the interchangeable marginal word imprinter as set forth previously with respect to FIGS. 5 and 6.

The numbering head 78 includes both the foot element 110 and a bar member 60 which is mounted to both the U-shaped bracket 79 and to the U-shaped member 18 which positions a felt inking device (not shown) in contact with the numbering head when the numbering head 78 is in the at rest position. When the numbering head is actuated and is moved to its extended position, the bar member 60 and the mounted inking device thereon is pivoted out of the way of the downward stroke of the numbering head, as shown by the dotted lines in FIG. 10.

In the following interchangeable heads, namely the bar-coder and imprinter, the dater and coder, the marginal word imprinter and the numberer, each of these interchangeable marking heads include a bar member 60 for holding an inking device adjacent the insignia mounted onto the marking head. A novel ink applying cartridge adapted for use to the above types of interchangeable heads is described and claimed in copending application entitled INK SUPPLY CARTRIDGE, Ser. No. 875,379 filed as a continuation-in-part application of Ser. No. 714,004, now abandoned, by the present applicant, and assigned to the same Assignee as the present invention.

What has been described hereinabove, is a unique electro-mechanical marking device unit which is adapted to receive a plurality of interchangeable marking heads to perform a plurality of functions as desired. Unexpectedly, it is possible, by the above described apparatus, to mount the device either on the infeed side of a printing machine, as well as mounting the same to the outlet feed side of a printing machine. Additionally, it is possible with the present invention to mount more than one of the electro-mechanical marking devices in series to perform a plurality of functions at the same time upon a stacked sheet feed assembly, a result which has heretofore been unknown in the art.

I claim:

1. An electro-mechanical marking device, for use with a machine having a frame and a stack sheet feed assembly for which individual sheets are removed intermittently in succession to subsequently have the machine perform an insignia applying operation thereon, said machine further including a driven circular element that rotates as each of the individual sheets is removed from the stack sheet feed, said marking device including in combination:

a housing having an open lower end and a pair of slide guide means fixedly mounted to said housing at the open end thereof, each of said slide guide means being positioned on opposite sides of said housing and extending below said housing, fastening means engageable with said housing for adjustably mounting the marking device to the machine above the stack sheet feed assembly, such that said slide guide means is positioned adjacent the uppermost sheet in the stack sheet feed assembly, drive element means slidably supported from said housing, electro-mechanical means mounted in said housing and engageable with said drive element to move the same from an at rest position to an extended actuated position, interchangeable marking head means adapted to be loosely mounted to and received by said slide guide means in said open end of said housing and mounted to be engaged by said drive means, said marking head means having foot element means mounted thereon, such that upon the energization of said electro-mechanical means, said drive element means, said marking head means and said foot element means are moved from an at rest position to an extended actuating position whereby said foot element means engages the stack sheet feed and marking head means engages the upper-most sheet on the stack sheet feed to mark the same.

2. The electro-mechanical marking device in accordance with claim 1 wherein said interchangeable marking head means includes U-shaped member means adapted to receive and hold said marking head means, said U-shaped member having a pair of depending legs and a connecting web, said depending legs being engageable with said pair of slide guide means to position and hold said marking head means in said housing to be operated thereby.

3. The electro-mechanical marking device in accordance with claim 2 further including spring means mounted between said U-shaped member means and said drive element means, said spring means being engageable with said drive element means when said drive element means is moved from the at rest position to the extended actuated position to thereby return said drive element means and said marking head means to the at rest position after each cycle of operation.

4. The electro-mechanical marking device in accordance with claim 1 further including electrical circuit means having first and second switch means and third switch means driven by the driven circular element on the machine, said third switch means being selectively engageable with the driven circular element to energize said electro-mechanical means to move said drive element means and said marking head means from the inward at rest position to the extended actuating position whereby said marking head means engages the uppermost sheet on the stack sheet feed assembly to mark the same prior to the movement of the uppermost sheet into the machine.

5. The electro-mechanical marking device in accordance with claim 1 wherein said electro-mechanical means is a solenoid.

6. The electro-mechanical marking device in accordance with claim 1 wherein said interchangeable marking head means includes bar-coding and imprinting means.

7. The electro-mechanical marking device in accordance with claim 1 wherein said interchangeable marking head means includes marginal word imprinting means.

8. The electro-mechanical marking device in accordance with claim 7 wherein said interchangeable marking head means further includes automatic indexing means.

9. The electro-mechanical marking device in accordance with claim 1 wherein said interchangeable marking head means includes manually indexing, dating and coding means.

10. The electro-mechanical marking device in accordance with claim 1 wherein said interchangeable marking head means includes hot stamping means.

11. The electro-mechanical marking device in accordance with claim 1 wherein said interchangeable marking head means includes label affixing means.

12. The electro-mechanical marking device in accordance with claim 1 wherein said interchangeable marking head means includes numbering means.

* * * * *